US005809712A

United States Patent [19]

Simanjuntak

[11] Patent Number: 5,809,712

[45] Date of Patent: Sep. 22, 1998

[54] SYSTEM FOR JOINING PRECAST CONCRETE COLUMNS AND SLABS

[76] Inventor: Johan Hasiholan Simanjuntak, Jl. Darmawangsa XII No. 131, Jakarta, Indonesia

[21] Appl. No.: 870,086

[22] Filed: Jun. 5, 1997

[30] Foreign Application Priority Data

Jun. 6, 1996 [ID] Indonesia ..... P-961540

[51] Int. Cl.[6] ..... E04C 5/08

[52] U.S. Cl. ..... 52/223.7; 52/236.8; 52/236.9; 52/251; 52/263; 52/283; 52/583.1; 52/585.1; 52/742.14; 52/747.12

[58] Field of Search ..... 52/223.7, 236.8, 52/236.9, 251, 263, 283, 583.1, 585.1, 742.14, 747.12

[56] References Cited

U.S. PATENT DOCUMENTS

| | | | |
|---|---|---|---|
| 3,562,979 | 2/1971 | Ali-Oglu | 52/236.8 X |
| 3,613,325 | 10/1971 | Yee | 52/236.8 |
| 4,081,935 | 4/1978 | Wise | 52/236.8 |
| 4,330,970 | 5/1982 | Bonink . | |

FOREIGN PATENT DOCUMENTS

| | | |
|---|---|---|
| 0004998 | 10/1979 | European Pat. Off. . |
| 6903098 | 9/1969 | Netherlands . |
| 7209390 | 1/1974 | Netherlands . |
| 1246178 | 9/1971 | United Kingdom . |

*Primary Examiner*—Christopher Kent
*Attorney, Agent, or Firm*—Christie, Parker & Hale, LLP

[57] ABSTRACT

A precast concrete system is provided that consists of columns and slabs joined together in one point. Each corner of the slab is equipped with a steel pipe mounted on a steel plate that is attached at and covers the top surface of the column. Each column is equipped with high tensile steel reinforcement strands protruding at the top end to penetrate the steel pipes of the four corners of four slabs, through the holes in the steel base plate attached at the bottom surface of the next column above it, and through the pipes implanted vertically at the lower section of the next column. The implanted pipes are in line with the holes on the base plate. The four steel pipes of four slabs meeting on one column are tied together with high tensile steel wire rope through three holes drilled horizontally at three places of the pipe length: upper, middle, and lower sections. The pipes of the slab corners and the gaps between pipes and slabs are filled with a special mortar cement that hardens fast. Then a special mortar cement is injected to the implanted pipes through each pipe's opening on the side surface of the column.

7 Claims, 8 Drawing Sheets

2
17
11
3
20
25
3
25
3
25
28
3
25
28
16
16
12
1

SYSTEM FOR JOINING PRECAST CONCRETE COLUMNS AND SLABS

FIELD OF THE INVENTION

This invention concerns a method of constructing a multistory building from precast concrete using columns and slabs as its structural elements.

BACKGROUND OF THE INVENTION

The use of precast concrete components for multistory buildings has earned significant position in the building construction industry for the benefits it offers. Benefits include:

Shorter construction time;

Better quality assurance;

Smooth concrete surfaces;

Cleaner construction area; and

Lower cost of production from standardized mass production.

In pre-fabricated precast systems, the joints between the components are the most crucial elements. Joining several precast concrete components in one single joint or at one place has to be done fast and efficiently, and more importantly is the assurance of its construction strength. The joint has to withstand all forces resulting from external load, such as its own weight, live load, and seismic forces. In the conventional construction system, where the columns, slabs, and beams are cast on site, structural problems at the joint between columns and beams or floor do not appear. As the components are cast on site together, they form a monolithic structure.

The use of precast concrete systems as the structure of multistory buildings has been limited by the difficulty in creating a joint system that is practical and economical, and able to overcome all forces resulting from its own weight, especially from seismic forces. Some popular and simple methods such as connecting columns and beams or floors with bolts or welding, have a handicap in their capability to withstand horizontal forces imposed by seismic forces. Those simple methods were designed only for withstanding gravitational force.

The objective of this invention is to produce a seismic resistant and fast method for connecting and joining precast concrete elements, consisting of reinforced concrete columns and beams, which indeed form the floor itself (hereafter called slab).

SUMMARY OF THE INVENTION

The floor element in this system is a panel made from ribs and concrete with thin plates in between, where the ribs function as beams. The sequence of assembling the precast elements is as follows.

Firstly, precast concrete columns are positioned vertically so that the steel anchors at the base floor fit in the steel pipe holes implanted in the lower section of the columns. Each concrete column is able to stand firmly by bonding it to steel anchors mounted on the base floor or at the head of the foundation. Special mortar cement is poured or injected through the other openings of the said pipes that are on the side surface of the column. The mortar cement flows down by gravity and fills up the passage of the pipes. As the mortar cement hardens, the column is sufficiently firm to stand without support. Then precast slabs are placed on top of the columns.

One slab with four corners is supported by four columns. One column is the junction of four slab corners of four slabs.

A column of the next story of the building is placed on top of the junction. Hence at one junction meet six ends of precast structural elements consisting of the top of the lower column, the four corners of four slabs, and the base of the next higher column, where they all form a single joint.

There is a structural bond among the reinforcement of the lower column, the structure of the four corners of slabs, and the upper column from the existence of high tensile steel strands rooted in the upper section of the lower column and anchored at the lower section of the upper column, There is also a structural bond among the slab corners by means of tying the steel pipes of the slabs'corners with high tensile steel wire rope through the holes drilled horizontally on the pipes'walls. The pipes and the gaps among the pipes are filled with mortar cement so that the wire rope and the four pipes of the four slabs come in contact and bind together. This system results in a practical and economical method of assembly and a reliable construction in terms of its strength. The following drawings are presented to illustrate the above description.

DETAILED DESCRIPTION OF THE INVENTION

Figure 1:
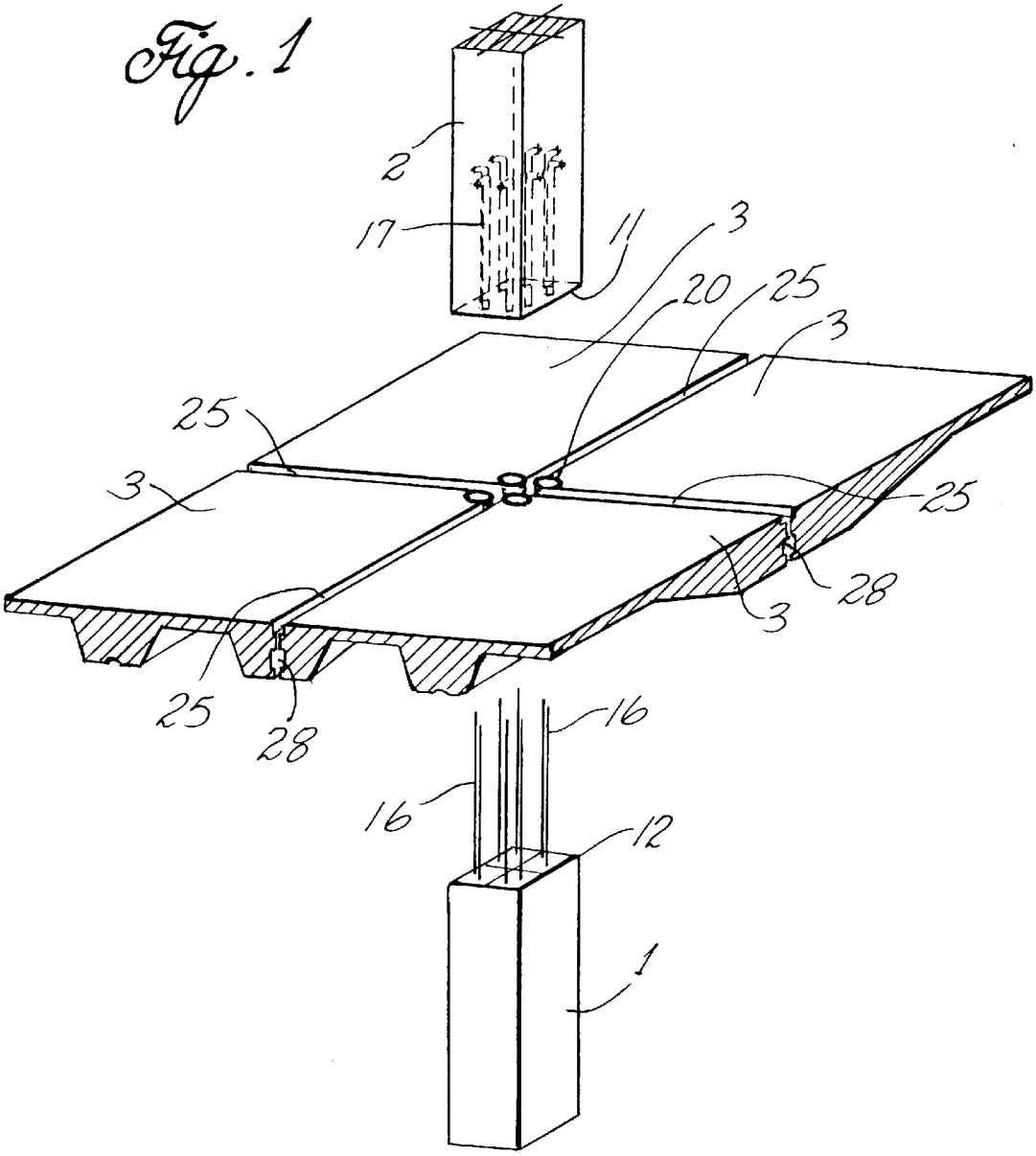
FIG. 1 is an exploded perspective view illustrating the precast concrete elements of the invention.

FIG. 1 shows in perspective the precast concrete elements: the upper section of the lower column (1), the four corners of the four slabs (3), and the lower section of the upper column (2) separately before joining. On the top of the lower column (1), there are a number of steel strands protruding (16), which are embedded in the lower column (1). In the lower section of the upper column (2) are implanted a number of steel pipes (17) vertically positioned at the bottom surface of the column (2) and bent toward the side surface of the column, so the other openings of the pipes are on and flat to the side surface of the column, The number of the steel pipes (17) is equal to the number of the steel strands (16) protruding from the lower column (1). FIG. 1 shows a partial view of four slabs (3) between the lower column (1) and the upper column (2). The corner of each slab (3) is laid on the surface of the steel plate (12) that is mounted on the top surface of the column (1). Steel pipes (20) which are firmly integrated in a vertical position to the corner of the slab (3) will convey the steel strand (16) protruding from the lower column (1) to enter the pipes (17) in the lower section of upper column (2).

Figure 2:
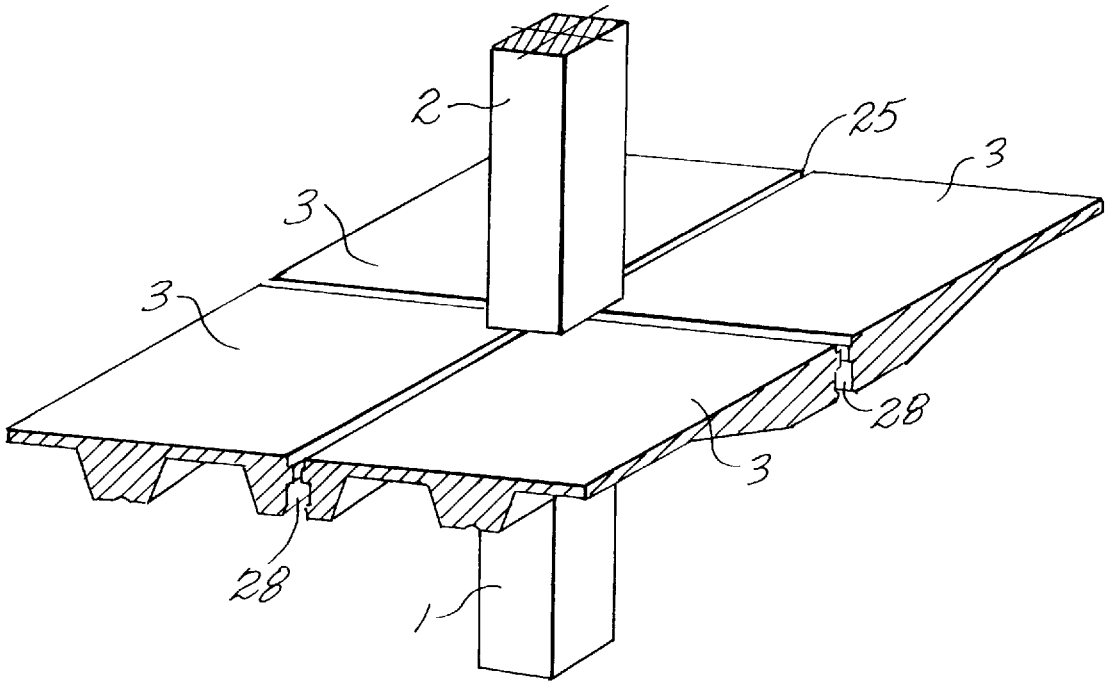
FIG. 2 is a perspective view illustrating the assembled precast concrete elements.

FIG. 2 shows in perspective the six structural elements in unity. A gap (25) between adjacent slabs (3) will be filled with special mortar mixed from portland cement, sand, and finely crushed stone. The perimeter of the slab has shear keys (28) which provide binding strength to one another at the meeting line.

Figure 3B:
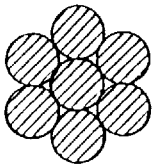
FIG. 3*b* is a cross-section view of a steel strand taken along line 3—3.
Figure 3A:
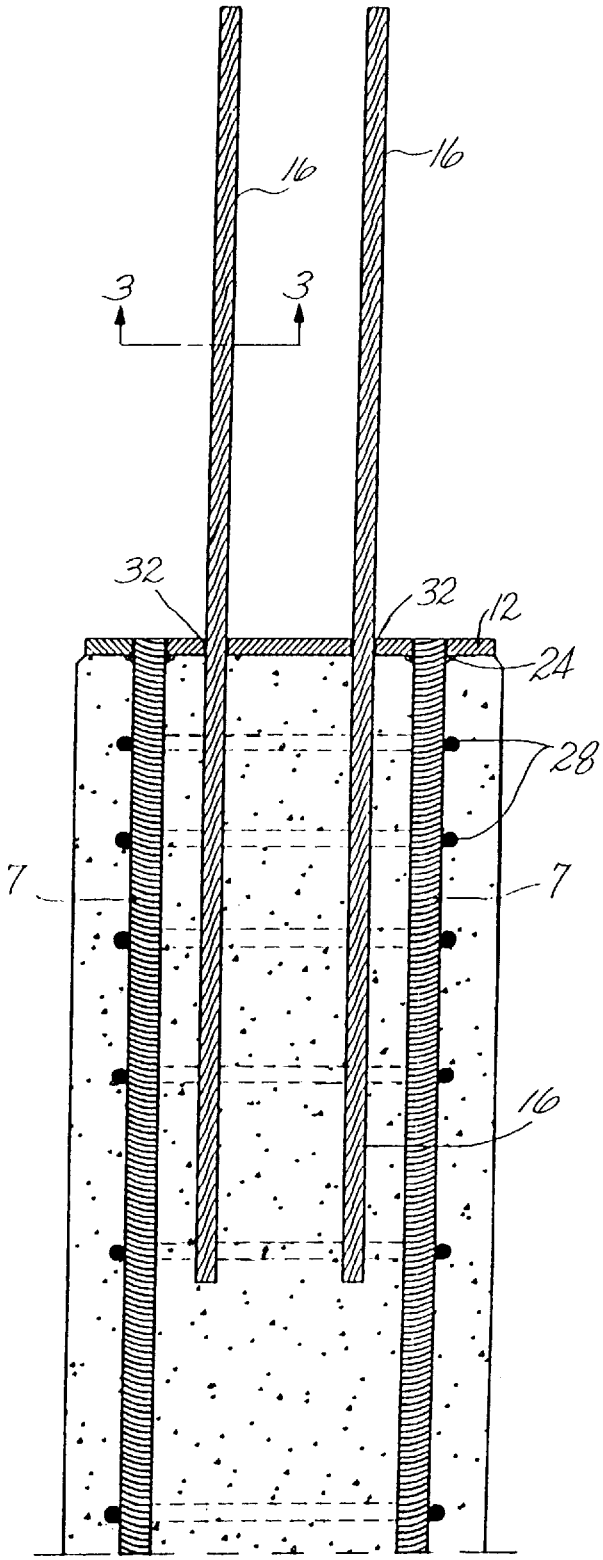
FIG. 3*a* is an elevation view in section of a lower column.

FIG. 3*a* shows the vertical cross-section of a lower column (1). Steel strands (16) which penetrate through holes (32) on the steel plate (12) are made of high quality steel with flexible properties. A single steel strand (16) consists of seven steel wires, each of approximately 4 mm. diameter, as illustrated in FIG. 3*b*. A steel strand made of seven 4 mm wires is standard in production and commerce and is known as pc strand. The main reinforcements (7) are surrounded by a stirrup reinforcement (8), and the ends of the main reinforcement (7) are connected by welding (24) them to the steel plate (12) along the edge of the holes on the plate surface that is in contact with the lower concrete column (1).

Figure 4:
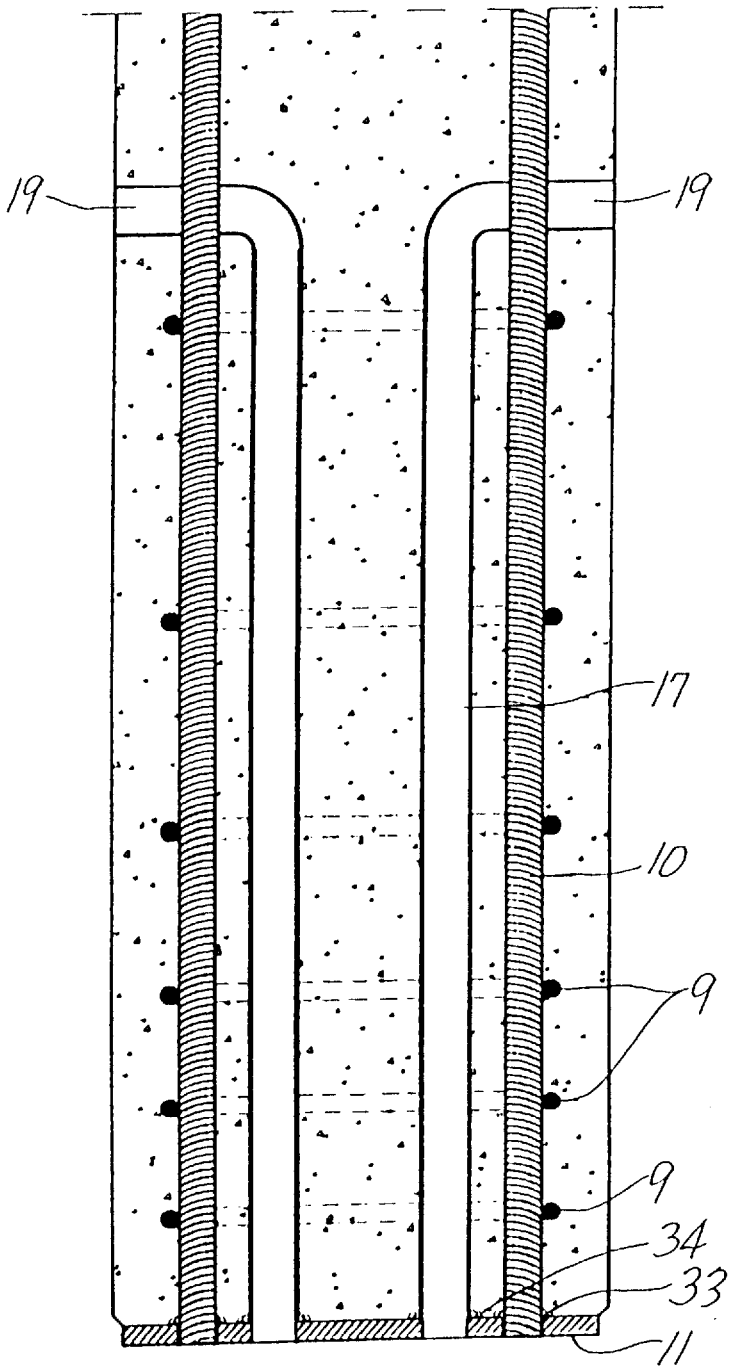
FIG. 4 is an elevation view in section of an upper column.

FIG. 4 shows the vertical cross-section of the upper column, (2). The steel pipes (17) function to take the steel strands (16) from the lower column (1), and through the pipe openings (19) which are on and flat to the side surface of the column (2). The special mortar cement (18) is injected to bind the steel strands (16) and the pipes (17) together (see FIG. 6*a*). The bottom ends of the pipes (19) are welded at the edge of the hole (34) on the steel base plate (11) surface that is in contact with the bottom of the upper column (2). The ends of the main reinforcements (10) are welded to the edge of the hole (33) on the surface of steel base plate (11) that is in contact with the concrete column. Hence, the free outer surface of the steel base plate (11) is flat and smooth. The main reinforcement (10) is surrounded by stirrup reinforcement (9) at a predetermined distance.

Figure 5:
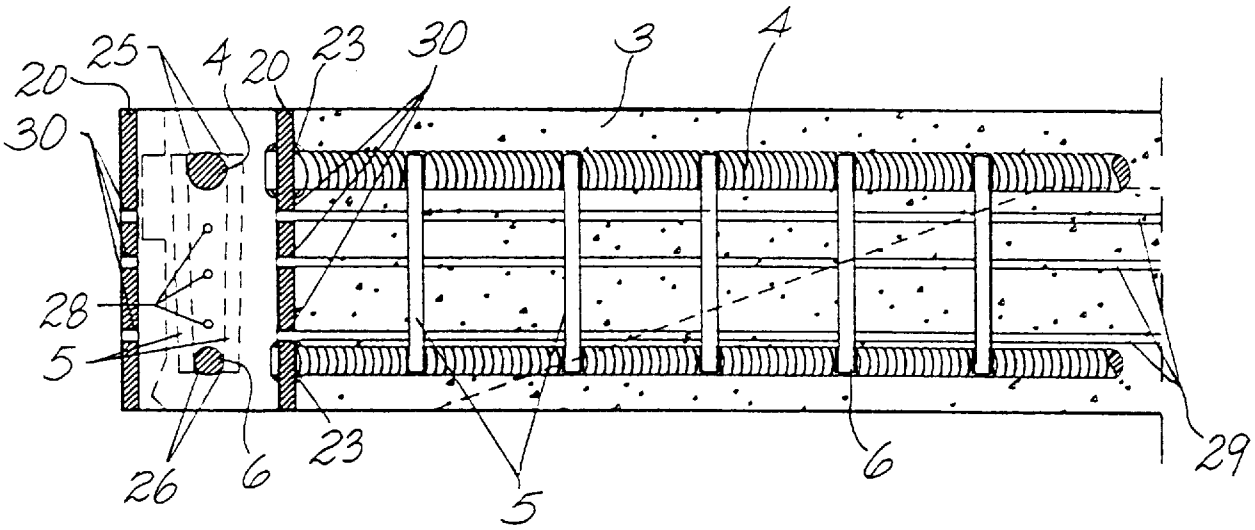
FIG. 5 is an elevation view in section of a slab corner.

FIG. 5 shows the vertical cross-section of a slab corner (3). A steel pipe (20) with a height equal to the thickness of the slab (3) is mounted perpendicularly to the two pairs of steel anchors (4 and 6) that are in perpendicular position to each other, by welding at the pipe holes (23), (25), and (26). A high tensile wire (29) of the prestress precast slab beam will slip through the holes (28) and (30) on the pipe wall (20).

Figure 6A:
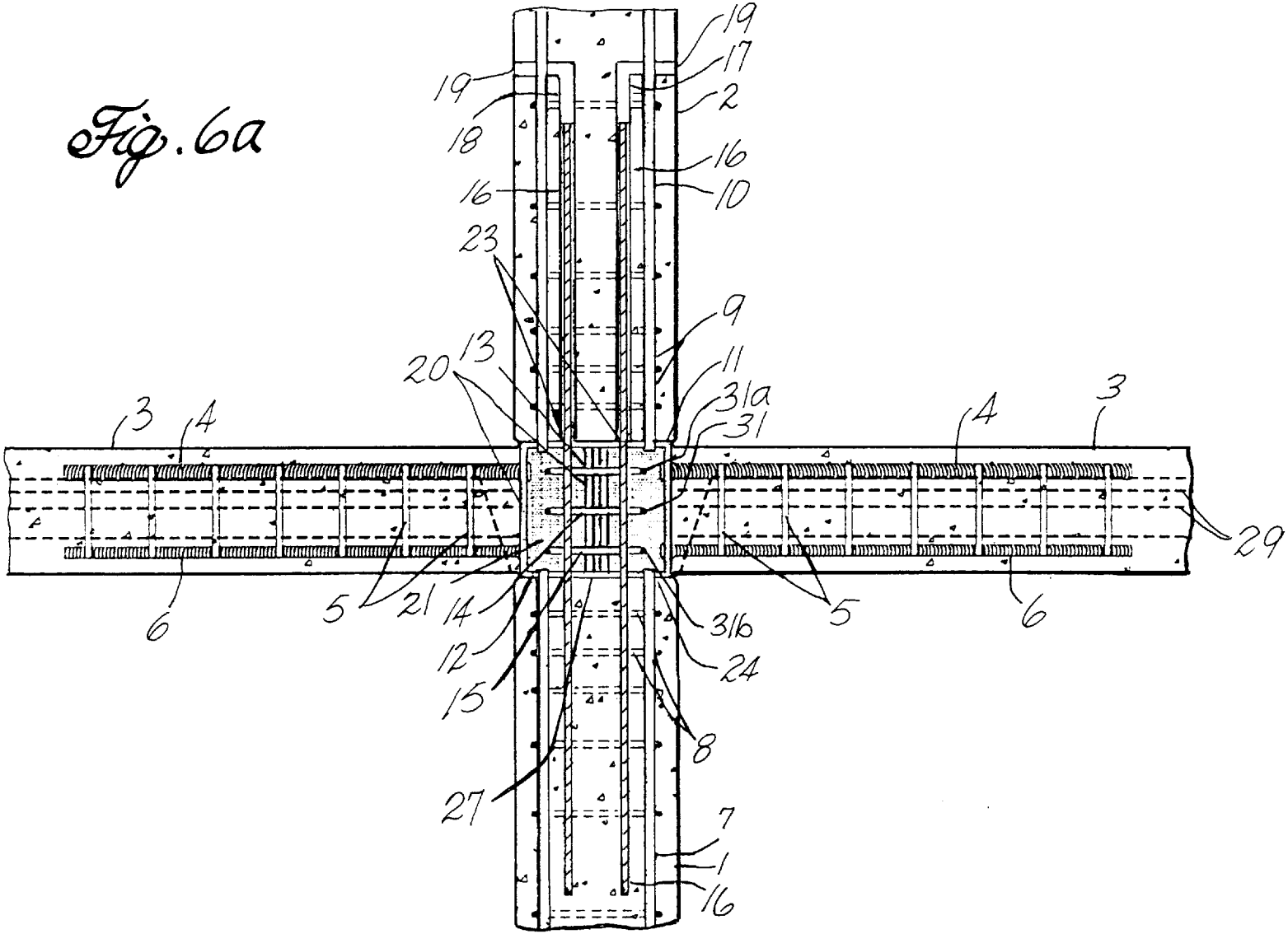
FIG. 6*a* and 6*b* are elevation views in section of the assembled elements.
Figure 6B:
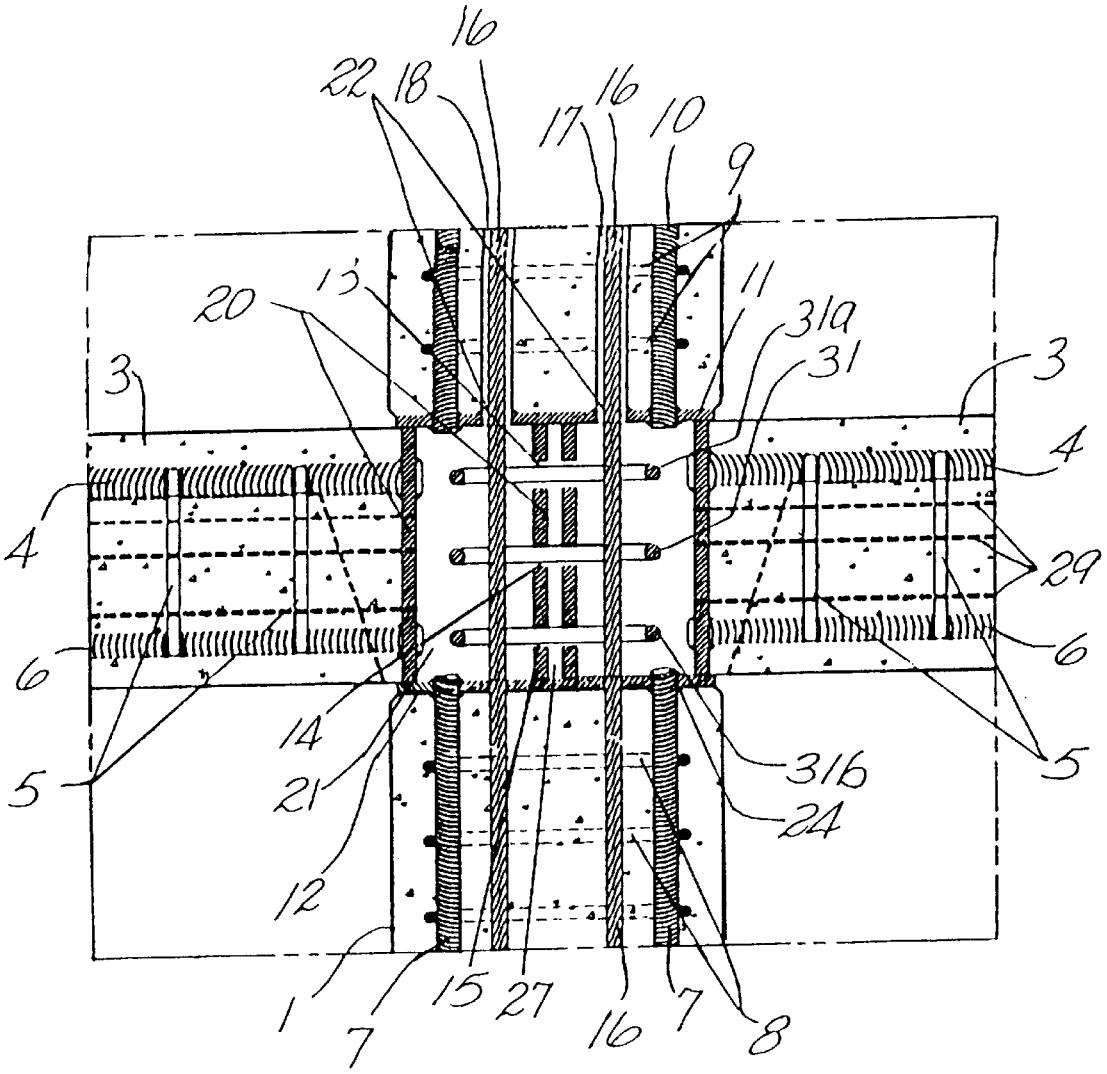

FIGS. 6*a* and 6*b* show the vertical cross-section of the upper section of lower column (1), the slab side (3), and the lower section of the upper column, (2), in an integrated position as one single joint. The steel strand (16), protruding from the lower column (1), is inside the steel pipe (20) of the beam (3) and the steel pipe (17) of the upper column (2). The four steel pipes (20) of four slabs (3) have holes (13), (14), and (15) through which slips flexible wire rope (31), (31*a*), and (31*b*) to tie the four steel pipes (20) together. Each steel pipe (20) and the gap between the pipes are filled with mortar cement (21) and (27).

Figure 7:
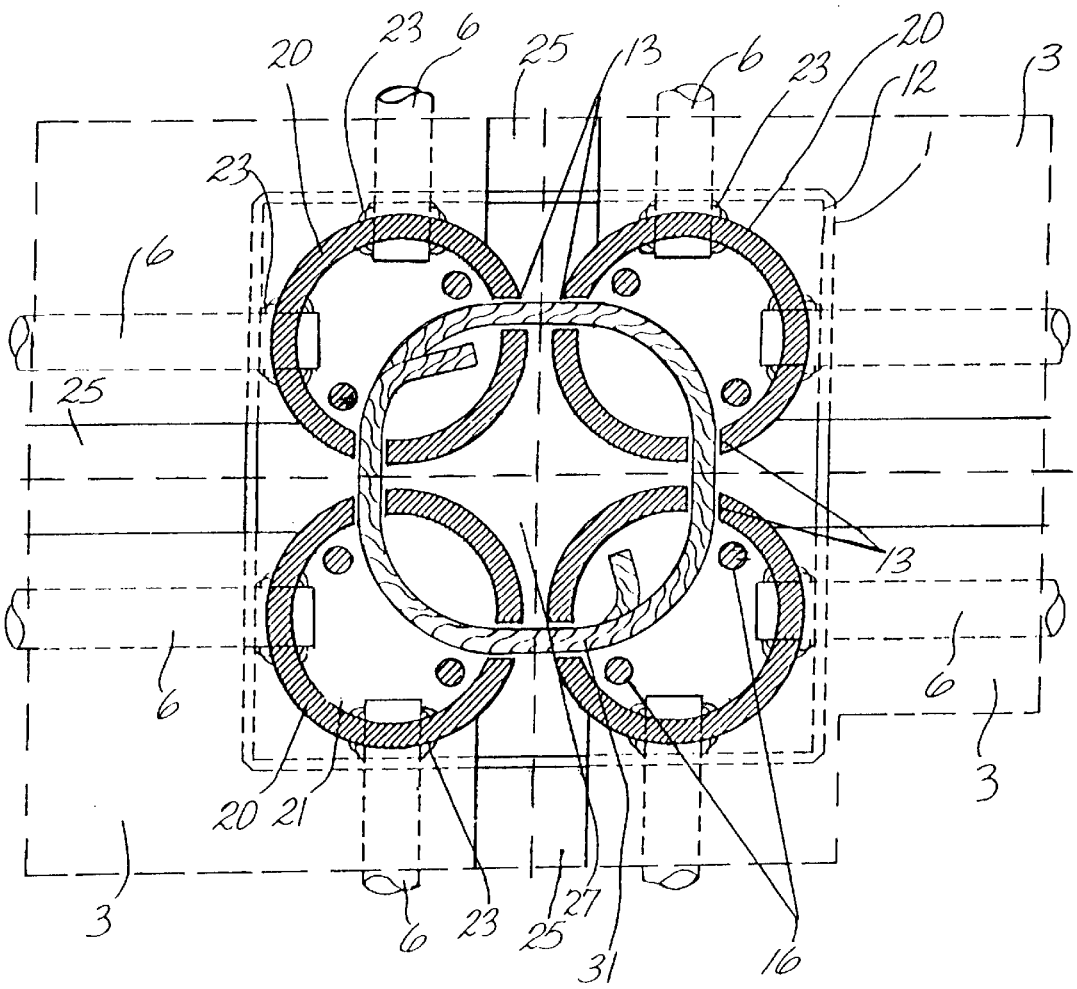
FIG. 7 is a plan view in section of an assembled joint between the elements of the present invention.

FIG. 7 shows the horizontal cross-section of the joint of four slab corners (3). The steel strand (16) protruding from the lower column (1) penetrates the steel pipe (20) of the slab (3), with two steel strands through each pipe (20). The drawing also shows a wire rope (31) tying together four steel pipes (20) through the pre-bored holes (13) on each pipe wall. The passage of the steel pipe (21), the gaps between pipes (27), and also the gaps between slabs (25), are filled with mortar cement. To the holes (23) of each steel pipe (20) are welded the ends of two pairs of anchors (6) in perpendicular position to each other.

As shown in FIG. 2, the precast structure components of the system are columns and slabs. The shape of the slab can be rectangular, but can also be a combination of small beams connected with thin concrete plates. The most important and critical part of construction is that the corners meet at the column ends. The firm integration of the structural elements which in this system consists of the joint of the top of the lower column with the bottom of the upper column, the joint of the top of the lower column and the four slab corners, and the tying of the slab corners together, all in one single joint and the practicality in assembly are the essence of this invention The interconnection of the reinforcement of each structural element meeting at the single joint is able to take and distribute vertical forces, horizontal forces, moment, and shear forces. This has been proven in a series of tests conducted by the Structural Laboratory of Housing Research Center, Department of Public Works of the Republic of Indonesia.

The steel strands (16) rooted at the upper section of the lower column (1) are to extend the reinforcement from the lower column (1) to the upper column (2). The passage of the steel pipe (17) with the steel strand (16) inside, is filled with special mortar cement so that the steel strand (16) adheres to the pipes, thus uniting firmly to the upper column (2). The adherence of the steel strand (16) and the lower column (2) results from the confined nature of the steel pipe (17) and the steel strand (16). For columns of 26×26 cm with four main reinforcement of diameter of 19 mm, to transfer maximum force that can be endured by the columns, that is from the lower column to the upper column or vice versa, eight high tensile steel strands of a diameter of ½ inch are used (16). From the technical specification of each main reinforcement (10) and steel strand (16), the tensile strength of two steel strands (16) is 2 to 3 times of the tensile strength of one main steel reinforcement (7) or (10). The high quality steel strand (16) consists of seven wires, each of 4 mm diameter. High tensile steel strands are commonly used for main reinforcement of prestressed concrete, but in this invention, the strand is not tensioned and does not function as prestressed steel. The characteristics of the steel strand suitable for this invention are the high tensile strength and the flexibility, so it is easy to direct the eight strands (16) to slip through the steel pipe holes (17) of upper column (2). The rugged surface of the strand (16) helps to increase the adherence between the mortar (18) and the strand (16). The steel strand of a relatively short length in this invention, is easily acquired as a waste from the high tensile steel strand usage in the prestress pretension concrete industry. FIG. 5 and 7 show the construction detail and the connection with the slab corners (3). Steel rods (4) and (6) that are welded to the steel pipe (20) at a point (23) with the steel rods (4) and (6) of approximately 100 cm in length function as anchors for the steel pipe (20) of the concrete slab (3). Several pairs of straight steel rods (5) are welded at uniform distances connecting the two steel anchors (4) and (6) to serve two functions: as a steel reinforcement to receive shear force, especially around the slab corner or around the steel pipe (20), and as a link for reinforcement (4) and (6) to become one construction frame that works together and as a strengthening reinforcement system in critical spots at corners where the load can come from external forces such as an earthquake, with a changing load direction. On the steel pipe wall (20) and between steel anchors (4) and (6), there are holes (30). The holes (30) enable steel rods (29) to cross steel pipe (20) from the peripheral beams of the slab and to function as prestress pretension reinforcement on the said beams.

FIG. 7 shows four slab corners (3) on column (1). It also shows a connection between the steel pipes (20) of the slabs (3) which are tied together by three high tensile wire ropes (31) that are slipped through pre-bored holes (13), (14), (15) on the pipe wall (20). The three wire ropes (31), (3l*a*), and (31*b*), are also shown in FIG. 6*b*. The passage of the steel pipe (21), the gaps between pipes (27) on the lower column (1), and the gaps between the slabs (25) are filled with special mortar. Observing FIGS. 6*a* and 6*b*, the flow of forces from one component to another especially those resulting from moment at the peripheral beams of the slab (3) and shear force from earthquake at the joint, can be explained as follows. Positive or negative moment from the peripheral beams of the slab (3) is firstly transferred to the steel pipe (20), then through the wire rope (31*a*) or (31*b*), some is conveyed to the next steel pipe (20) and some is taken by the high tensile steel strand (16) inside the pipe (20). The steel strand (16) in the upright position is confined in the pipe (17) with special mortar cement. The wire rope (31) positioned in the middle, functions to take shear force in the center of the joint, with the direction of the shear force being at a 45 degree angle due to the shear force. The uniting characteristic of the structural construction at the bottom of the upper column (2) and also the top of lower column (1) is provided by the firm connection between the main reinforcement of each column (7) and (10) with the steel plate (1 1) and (12), so that the horizontal force or shear force between the column and the top surface of the pipe of the four corners (20) can be transferred from the main reinforcement (10) to the steel strand (16) through the steel plate (11).

What is claimed is:

1. A system for construction of a multistory building with precast elements comprising:

a plurality of vertical columns, each column having first and second column ends, wherein for each vertical column the second column end includes a plurality of longitudinal conduits running lengthwise through the column along a portion of its length;

a plurality of horizontal slabs, each slab having at least one corner defined by two side edges, each of the at least one corners including a vertical conduit extending between top and bottom surfaces of the slab and a horizontal conduit extending between the two side edges of the slab;

a first plurality of flexible, high tensile strands anchored in the first column end of each of the vertical columns, each strand for passing from a first of the plurality of columns through the vertical conduit of one of the plurality of slabs and into the longitudinal conduit of a second of the plurality of columns for anchoring the first column, the slab and the second column to one another; and a second plurality of flexible, high tensile strands for passing through the horizontal conduits of adjacent slabs of the plurality of slabs to anchor the slabs to one another.

2. The system of claim 1 wherein the first column end of each column includes a steel end plate from which the first plurality of flexible strands extends, each column further including a plurality of longitudinal steel reinforcing anchors extending lengthwise through the column and welded to the end plate.

3. The system of claim 1 wherein each slab is rectangular and the vertical conduit is a steel pipe and each slab further includes steel reinforcing anchors welded to the pipe and extending from the steel pipe into the concrete.

4. The system of claim 3 wherein the corner of each slab includes an upper horizontal steel plate and a lower horizontal steel plate welded to the steel pipe.

5. The system of claim 1 wherein the second column end of each column has a steel end plate with a plurality of perforations aligned with the longitudinal conduits of each of the second column ends, each column further including longitudinal steel reinforcing anchors welded to the end plate.

6. A method for constructing a structure comprising the steps of:

anchoring a first plurality of vertical columns in a grid arrangement, the first plurality of vertical columns each including a first plurality of flexible, high tensile strands extending upwardly from its corresponding vertical column;

placing a plurality of horizontal slabs atop the first plurality of vertical columns, each horizontal slab having at least one vertical conduit through which at least one of the high tensile strands is extended;

tying adjacent slabs of the plurality of horizontal slabs to one another by a second plurality of flexible, high tensile strands which extend through the slabs through horizontal conduits defined by the slabs;

placing a second plurality of vertical columns atop the horizontal slabs with each of the second plurality of vertical columns aligned with a corresponding vertical column from the first plurality of vertical columns wherein the first plurality of strands of each of the first plurality of vertical columns extends through a plurality of longitudinal conduits in the corresponding vertical column of the second plurality of vertical columns; and filling the vertical conduits of the horizontal slabs and the longitudinal conduits of the second plurality of vertical columns with mortar.

7. The method of claim 6 wherein the plurality of horizontal slabs is a first plurality of horizontal slabs and each of the second plurality of vertical columns includes an upper end with a third plurality of flexible, high tensile strands extending upwardly from the vertical column; the method further comprising the step of placing a second plurality of horizontal slabs atop the second plurality of vertical columns, each horizontal slab having at least one vertical conduit through which at least one of the third plurality of high tensile strands can be extended.

* * * * *